US006552486B1

(12) United States Patent
Wani et al.

(10) Patent No.: US 6,552,486 B1
(45) Date of Patent: Apr. 22, 2003

(54) PLASMA DISPLAY PANEL WITH SEMITRANSPARENT FRONT SUBSTRATE AND FILTER

(75) Inventors: Koichi Wani, Osaka (JP); Kazunori Hirao, Osaka (JP); Koji Aoto, Osaka (JP); Yoshihito Tahara, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/443,850

(22) Filed: Nov. 19, 1999

(30) Foreign Application Priority Data

Nov. 27, 1998 (JP) ..... 10-337176

(51) Int. Cl.[7] ..... H01J 17/49
(52) U.S. Cl. ..... 313/489; 313/585
(58) Field of Search ..... 313/112, 587, 313/586, 17, 22, 581, 582, 584; 428/428

(56) References Cited

U.S. PATENT DOCUMENTS 4,703,229 A * 10/1987 Nighan et al. ..... 313/582
4,741,963 A * 5/1988 Wada et al. ..... 428/428
5,811,923 A * 9/1998 Zieba et al. ..... 313/112
5,998,935 A * 12/1999 Marcotte ..... 313/582
6,072,276 A1 * 6/2001 Okajima ..... 313/581
6,242,859 B1 * 6/2001 Betsui et al. ..... 313/584
6,297,582 B1 * 10/2001 Hirota et al. ..... 313/112

FOREIGN PATENT DOCUMENTS

EP 0 813 220 A1 * 12/1997 ..... H01J/5/16
JP 9-306366 11/1997 ..... H01J/11/02

* cited by examiner

*Primary Examiner*—Michael H. Day
(74) *Attorney, Agent, or Firm*—Merchant & Gould, P.C.

(57) ABSTRACT

A front substrate and a back substrate are placed opposing each other separated by a discharge space. The front substrate is made of a semitransparent material such as a dark color glass with a mean transmittance for visible light of 60 to 80%. On the front substrate, a group of electrodes including pairs of scanning electrodes and sustaining electrodes covered with a dielectric layer and a protective coating are provided. Data electrodes and spacers are formed on the back substrate, and phosphors are provided on the data electrodes towards the side of the spacers. A front filter, which is made of a semitransparent glass sheet with a mean transmittance for visible light of 60 to 80%, is disposed on the front side of the front substrate. The present invention realizes a display with less halation and high contrast. Also, a detection rate of a defect in electrodes, which are formed on the front substrate, improves.

5 Claims, 7 Drawing Sheets

PLASMA DISPLAY PANEL WITH SEMITRANSPARENT FRONT SUBSTRATE AND FILTER

BACKGROUND OF THE INVENTION

1. Field of the Invention

The present invention relates to a plasma display panel used for displaying an image in a television receiver or a computer and a method for manufacturing the same.

2. Description of the Prior Art

FIG. 7 shows a conventional AC type plasma display panel. As is shown in FIG. 7, the conventional AC type plasma display panel (hereinafter, referred to as a panel) 1 is provided with a front substrate 3 and a back substrate 4 opposing each other separated by a discharge space 2. The front substrate 3 is a transparent glass substrate, on which a group of electrodes including pairs of belt-like scanning electrodes 7 and sustaining electrodes 8 covered with a dielectric layer 5 and a protective coating 6 are arranged in parallel. Belt-like data electrodes 9 are arranged in parallel on the back substrate 4 in the direction perpendicular to the scanning electrode 7 and the sustaining electrode 8. Belt-like spacers 10 are provided between the data electrodes 9 in order to separate data electrodes 9 and form the discharge space 2. Also, phosphors 11 are formed on the data electrodes 9 towards the side of the spacers 10. Mixed gas of xenon and at least one of the rare gases selecting from helium, neon and argon is sealed in the discharge space 2.

In this panel 1, an image display is seen from the front substrate 3 side. Ultraviolet light, which is generated by discharges between the scanning electrode 7 and the sustaining electrode 8 in the discharge space 2, excites the phosphors 11, then visible light from this phosphors 11 is used for the light emitted by the display.

In general, a contrast ratio of the display in a bright ambience needs to be at least 50:1. When the inventors measured the brightness at the illumination of 150 lx of an AC type plasma display panel using a conventional transparent glass substrate (mean transmittance for visible light is approximately 94%) as the front substrate, the maximum brightness of the light emitted by the display was 450 cd/m$^2$ and the background brightness due to reflection of external lights was 16 cd/m$^2$. Accordingly, the contrast ratio was as small as about 28:1. In this case, the mean transmittance for visible light means a mean value of the transmittance within the wavelength range of the visible light (360 to 830 nm), and, in the following, the mean transmittance refers to the mean transmittance for visible light.

As a method for making the contrast ratio at least 50:1, a glass substrate with a dark color can be used as the front substrate. For example, the mean transmittance r of this dark color glass substrate can be calculated with the formula below so that the contrast ratio may be 50:1.

$$450(r/0.94)/\{16(r^2/0.94)\}=50$$

r=0.52 is obtained with this formula. Therefore, the required mean transmittance of the front substrate is approximately 50%.

However, as is described above, the scanning electrodes 7, the sustaining electrodes 8, the dielectric layer 5 and the protective coating 6 are formed on the front substrate 3. During their forming step, a pattern defect in the scanning electrodes 7 and the sustaining electrodes 8, an internal defect and dust in the dielectric layer 5 or the protective coating 6 are checked for. A defect checking device for this purpose has been automated with image recognition technologies. In order to increase the defect detection rate, an appropriate illumination from both surfaces of the front substrate 3 is necessary. When a glass substrate with a mean transmittance of 50% is used as the front substrate 3, especially the illumination from the front side of the front substrate 3 (the side of the front substrate 3 that opposes the one on which the scanning electrodes etc. are formed) is not appropriate, resulting in a considerable decrease in the defect detection rate with this defect checking device.

In addition, as another method for making the contrast ratio at least 50:1, a filter made of a dark color glass with a mean transmittance of approximately 50% can be provided on the front surface of the transparent front substrate 3. However, when an image with black and white displays adjacent each other is displayed on this panel, the white display is blurred in the region near the border that should be the black display. This is called halation.

SUMMARY OF THE INVENTION

It is an object of the present invention to solve the problems above and to provide a plasma display panel and a method for manufacturing the same, which realizes a preferable display with less halation and high contrast and improves the detection rate of a defect and dust in the scanning electrodes and the sustaining electrodes, which are formed on the front substrate.

The plasma display panel in accordance with the present invention includes a front substrate, a back substrate opposing the front substrate and separated therefrom by a discharge space, and a front filter provided on a front side of the front substrate. Mean transmittances for visible light of the front substrate and the front filter are 60 to 80% respectively.

With this configuration, halation and external light source reflection lessen, contrast increases, and reflected images can be suppressed. Also, a defect and a dust in the scanning electrodes and the sustaining electrodes, which are formed on the front substrate, can be detected with a high probability.

The method for manufacturing the plasma display panel in accordance with the present invention includes forming scanning electrodes and sustaining electrodes on a front substrate with a mean transmittance for visible light of 60 to 80%, checking for defects by illuminating from a front side of the front substrate, forming a dielectric layer and a protective coating covering the scanning electrodes and the sustaining electrodes, placing a back substrate in opposition to the front substrate and sealing a place therebetween, sealing a gas between the front substrate and the back substrate, and providing a front filter with a mean transmittance for visible light of 60 to 80% in the front side of the front substrate.

With this method, a defect and dust in the scanning electrodes and the sustaining electrodes, which are formed on the front substrate, can be detected with a high probability, leading to a reliable inspection in the manufacturing step.

DESCRIPTION OF THE PREFERRED EMBODIMENTS

There are plasma display panels with a variety of structures. The following is a description of a surface discharge AC type plasma display panel as a preferred embodiment of the present invention, with reference to the accompanying drawings.

Figure 1:
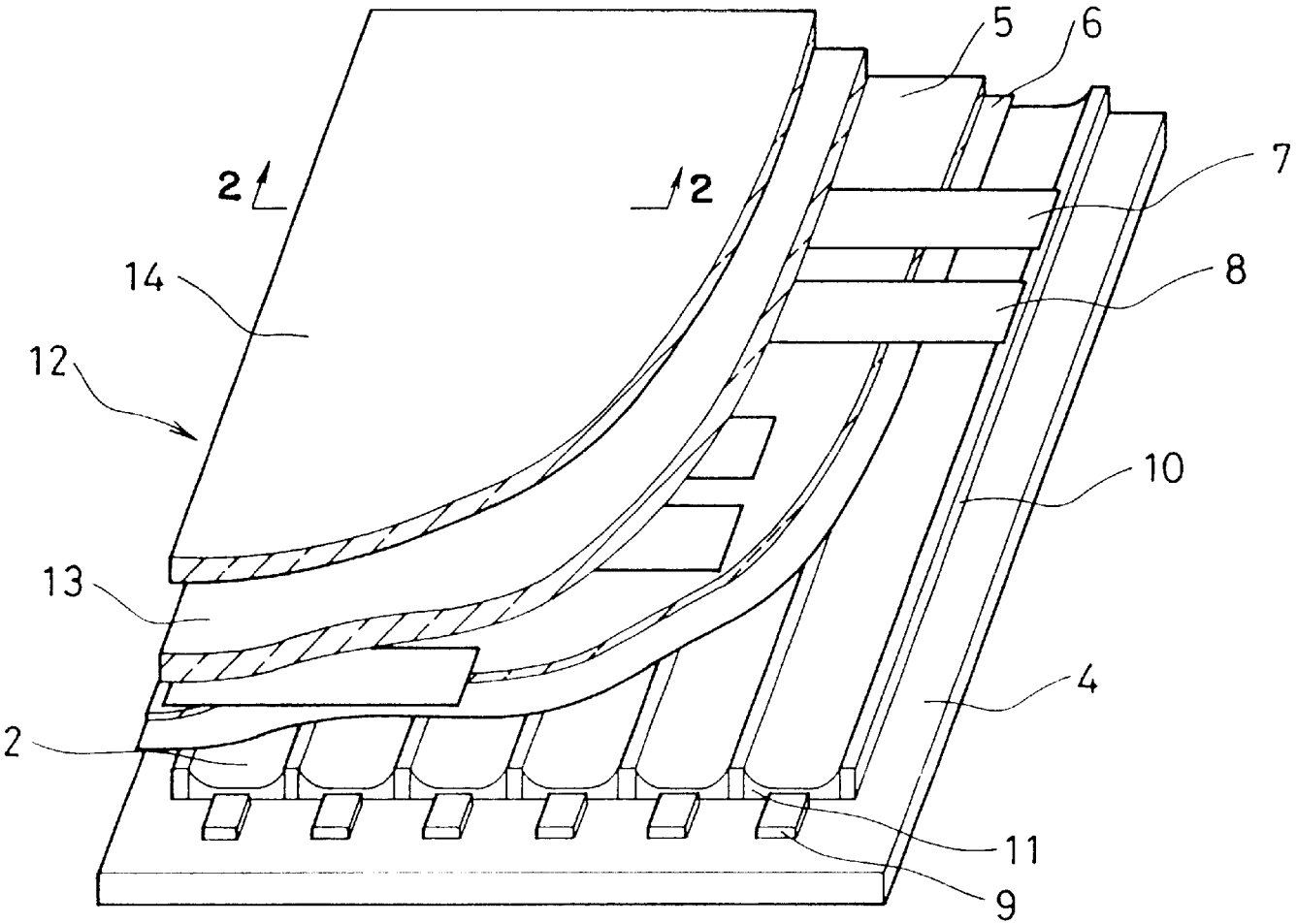
FIG. 1 is a partially broken perspective view illustrating an AC type plasma display panel of an embodiment in accordance with the present invention.

As is shown in FIG. 1, a surface discharge AC type plasma display panel of a preferred embodiment of the present invention (hereinafter, referred to as a panel) 12 is provided with a front substrate 13 and a back substrate 4 opposing each other separated by a discharge space 2. The front substrate 13 is made of a semitransparent material such as a dark color glass with a mean transmittance of 70% and has a thickness of 3 mm. On this front substrate 13, a group of electrodes including pairs of belt-like scanning electrodes 7 and sustaining electrodes 8 covered with a dielectric layer 5 and a protective coating 6 are arranged in parallel.

Belt-like data electrodes 9 are arranged in parallel on the back substrate 4 in the direction perpendicular to the scanning electrode 7 and the sustaining electrode 8. Belt-like spacers 10 are provided between the data electrodes 9 in order to separate data electrodes 9 and to form the discharge space 2. Also, phosphors 11 are formed on the data electrodes 9 towards the side of the spacers 10. Mixed gas of xenon and at least one of helium, neon and argon is sealed in the discharge space 2.

Furthermore, a front filter 14 with a thickness of 3 mm, which is made of a semitransparent glass substrate with a mean transmittance of 70%, is disposed on the front side of the front substrate 13. The front substrate 13 and the back substrate 4 are disposed together but in a separate step from the front filter 14 in a body that stores the panel 12, such that there is a gap between the front substrate 13 and the front filter 14. The gap mentioned above is formed by providing spacer blocks, made of such materials as acrylic resins or aluminum, between the front substrate 13 and the front filter 14 at right and left sides or four corners thereof. As a result, the top and bottom surfaces of the panel 12 have openings, based on the gap, to facilitate air flow.

In this panel 12, an image display is seen from the side of the front filter 14, which is the display side. When a high voltage is applied between the scanning electrodes 7 and the sustaining electrodes 8, a discharge of a rare gas occurs in the discharge space 2, thus radiating ultraviolet light. The radiated ultraviolet light excites the phosphors 11, and then visible light generated from this phosphors 11 is used for the light emitted by the display.

Next, a method for manufacturing the panel 12 of the present embodiment is described.

A transparent conductive material such as ITO (Indium Tin Oxide) and stannic oxide ($SnO_2$) and a metallic material such as silver (Ag) and chromium (Cr)—copper (Cu)—chromium (Cr) are formed in belt shape on the front substrate 13 with a sputtering method or a printing method, thereby forming the scanning electrodes 7 and the sustaining electrodes 8. Then, by illuminating from the front side of the front substrate 13 on which the scanning electrodes 7 and the sustaining electrodes 8 are formed (the surface opposing the one on which the scanning electrodes are formed), whether there is a defect such as a fault of the scanning electrode 7 and the sustaining electrode 8 is checked with a defect checking device. Subsequently, the scanning electrodes 7 and the sustaining electrodes 8 are covered with a glass material made of a borosilicate glass or the like, which is layered on the front substrate 13 by the printing method, and the dielectric layer 5 is formed by firing the above at the temperature higher than the softening point of the glass material. The protective coating 6 made of magnesium oxide is formed on the dielectric layer 5 by an electron-beam evaporation method. Subsequently, whether there is dust is checked with the defect checking device.

A metallic material such as silver is formed into the data electrode 9 on the back substrate 4 with the printing method. The spacer 10 is formed by printing a glass material. Subsequently, the phosphor 11 is applied between the spacers 10.

The front substrate 13 and the back substrate 4 obtained above are placed opposing each other and sealed together along the periphery of them, and then a discharge gas is sealed therein. Then, after spacer blocks for forming a gap, which are made of such materials as acrylic resins or aluminum, are placed at right and left sides or four corners on the front side of the front substrate 13, the back substrate 4 is layered over the front substrate 13, forming openings in vertical direction, thereby completing the pane 12.

Figure 2:
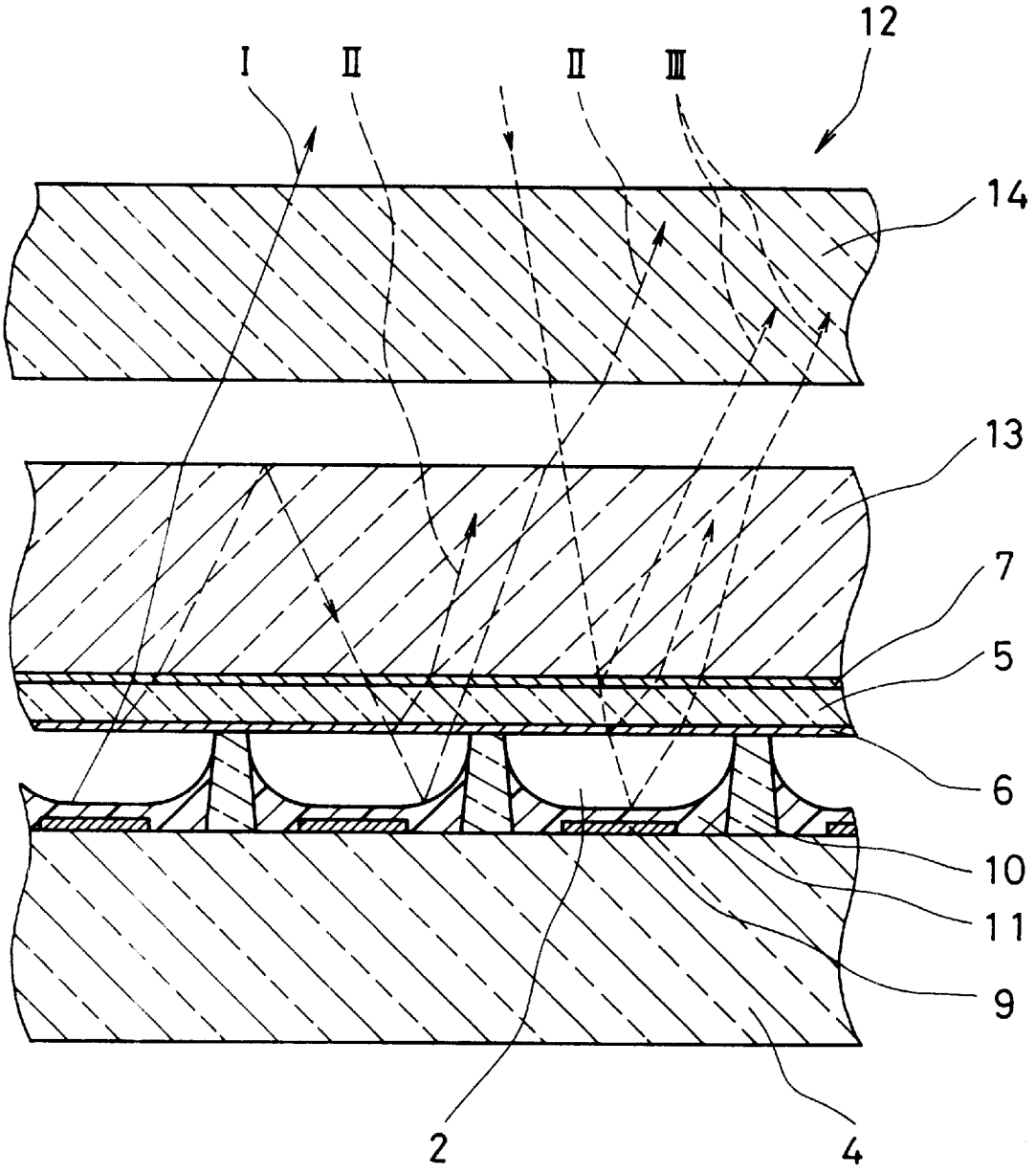
FIG. 2 is a cross sectional view of FIG. 1 along the line 2—2.

Next, the following is a description of the path of the light emitted by the display, with reference to FIG. 2, which is a cross-sectional view of FIG. 1 along the line 2—2.

In the panel 12 in accordance with the present embodiment, as is shown in FIG. 2, most of the light emitted from the phosphors 11, which is shown in a solid line I, is radiated towards the front side from the front substrate 13 made of a semitransparent material. A part of the light emitted from the phosphors 11, which is shown in a long dashed line II, repeats reflecting within the dielectric layer 5 and the front substrate 13, shines into an adjacent discharge cell, and is again radiated towards outside from the phosphor in the discharge cell. The radiated light is absorbed when it shines into the semitransparent front substrate 13. Thus, halation can be suppressed.

In addition, a part of ambient light, which shines into the front substrate 13 from outside and is shown in a middle dashed line III in FIG. 2, is reflected on the surface of the front substrate 13 or the dielectric layer 5, again radiated towards outside, and absorbed by the front filter 14 and the front substrate 13. As a result, the background brightness of an image due to external light is sufficiently reduced, and unnecessary light that is radiated towards outside from the display surface and has nothing to do with the display decreases, thereby improving the contrast.

The following is a description of the result of measuring the halation.

Figure 3:
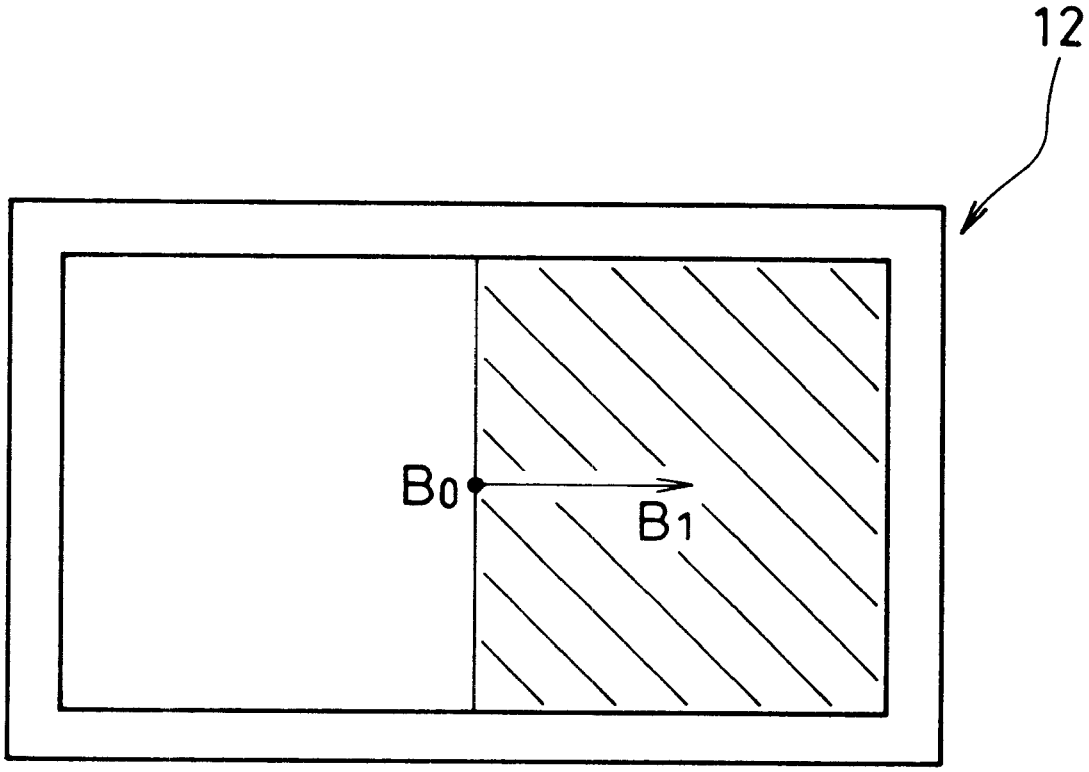
FIG. 3 is a drawing showing a panel display pattern for measuring halation.

A 42-inch panel with horizontally 853 pixels and vertically 480 pixels, whose four sides are 1.08 mm each, is used. As is shown in FIG. 3, the left half of the panel displays white, and the right half displays black. Then halation is measured near the border of the white display and the black display. The hatched area in FIG. 3 is the black display.

Figure 4:
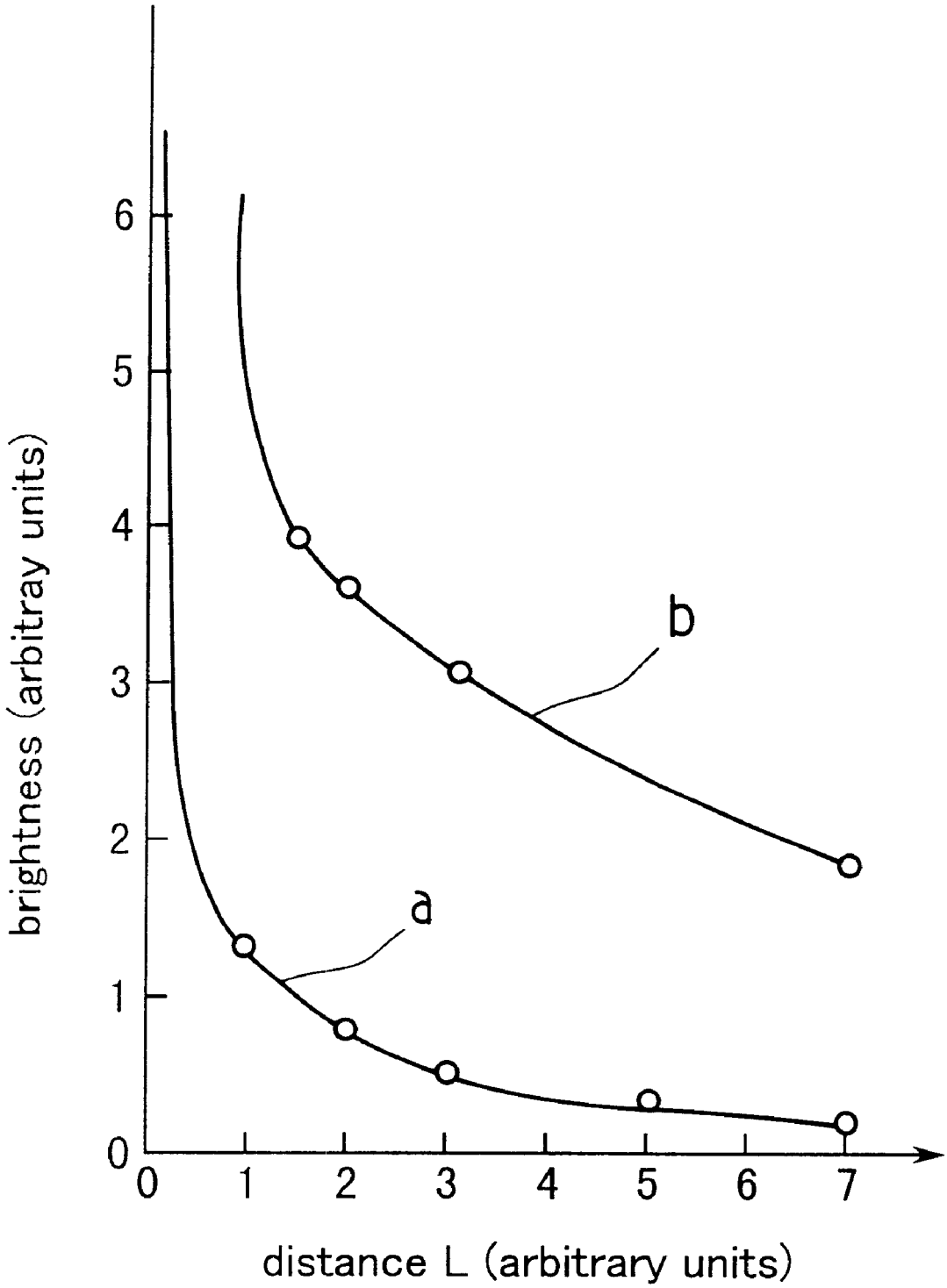
FIGS. 4 is a graph showing the result of measuring the halation.

A curve a in FIG. 4 shows the result of measuring the halation using the panel in accordance with the present embodiment. Also, for a comparison, a curve b shows the result of measuring the halation using the panel having a transparent front substrate and a front filter with a mean transmittance of 50%.

When the point $B_0$ in FIG. 3 is seen as the origin O, the horizontal axis of the graph in FIG. 4 shows a distance L from O in the direction of $B_1$. The graph shows that as the brightness rapidly decreases along with an increase of the distance L, the halation reduces. The panel of the present embodiment shows considerably less halation than the panel of the comparison example. Although not shown in FIG. 4, a panel using a transparent front substrate and not using a front filter shows substantially the same result as the comparison example described above. Therefore, the front filter is less effective in preventing halation.

In the present embodiment, since light radiated from the phosphor 11 is absorbed by the front substrate 13 and the front filter 14 by 70% respectively, the combined mean transmittance is calculated as 0.7×0.7÷0.5, thereby realizing a preferable display with less reflection of external light, high contrast and less reflected images, as is the case with using a dark color glass substrate with a mean transmittance of 50% as the front substrate and not using a front filter. Furthermore, by adopting the front substrate 13 with a mean transmittance of 70%, the defect detection rate in the manufacturing steps has become at least 98%, which is dramatically improved compared with approximately 70% in the case of using the front substrate with a mean transmittance of 50%.

Moreover, in terms of a material for a front filter, the similar effects can be obtained with resins such as acrylic other than glass.

In the present embodiment, the example of adopting the front substrate and the front filter with a mean transmittance of 70% has been described. When the mean transmittance of the front substrate 13 is less than 60%, the defect detection rate mentioned above decreased abruptly, thus causing a problem in manufacturing. Also, when the mean transmittance of the front substrate 13 is greater than 80%, the effect of preventing halation showed a considerable decrease. Thus, the appropriate mean transmittance of the front substrate is 60 to 80%. By adopting the front filter, which is to be combined with this front substrate, with a mean transmittance of 60 to 80%, the contrast ratio of the panel in a bright place is brought to be at least 50:1.

As is described above, with the panel in accordance with the present embodiment, a preferable display with high contrast and less reflected images of external light can be obtained, and also a defect in the scanning electrodes, the sustaining electrodes, the dielectric layer and the protective coating, which are formed on the front substrate, can be detected with a high probability.

In the following, it is explained that an optimization of a distance between the front substrate 13 and the front filter 14 efficiently enhances heat release of the panel.

When the front filter 14 is not provided, or when the front filter 14 is disposed closely in contact with the front substrate 13, the heat generated by discharges reaches the front substrate 13 or the surface of the front filter 14 by heat conduction, and then is radiated to outside of the device. Therefore, in order to enhance the heat release from the front substrate 13 or the front filter 14, air cooling from the outside with a cooling fan was necessary.

Figure 5:
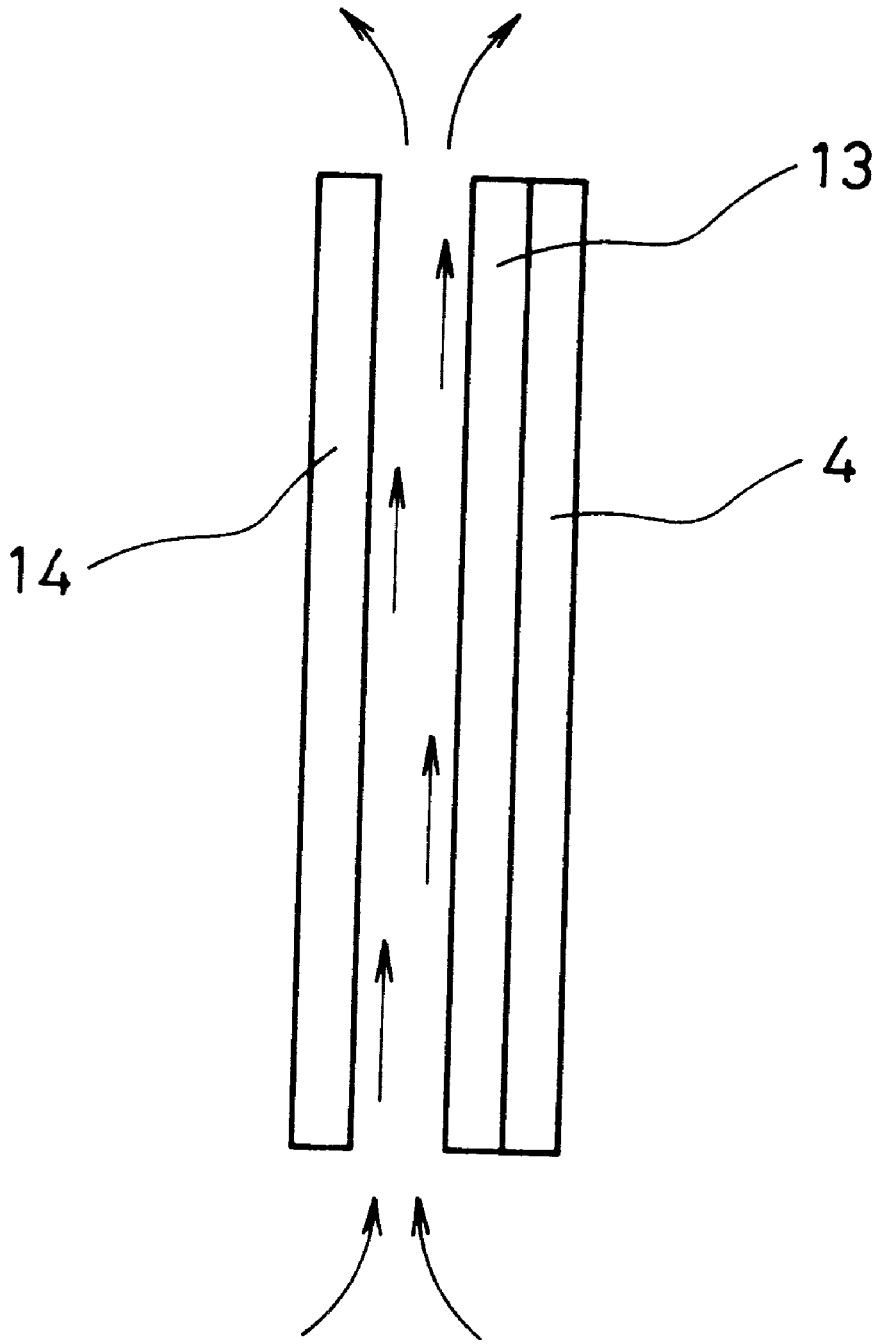
FIG. 5 is a side view for describing heat convection in the gap between the panel and the front filter.
Figure 6:
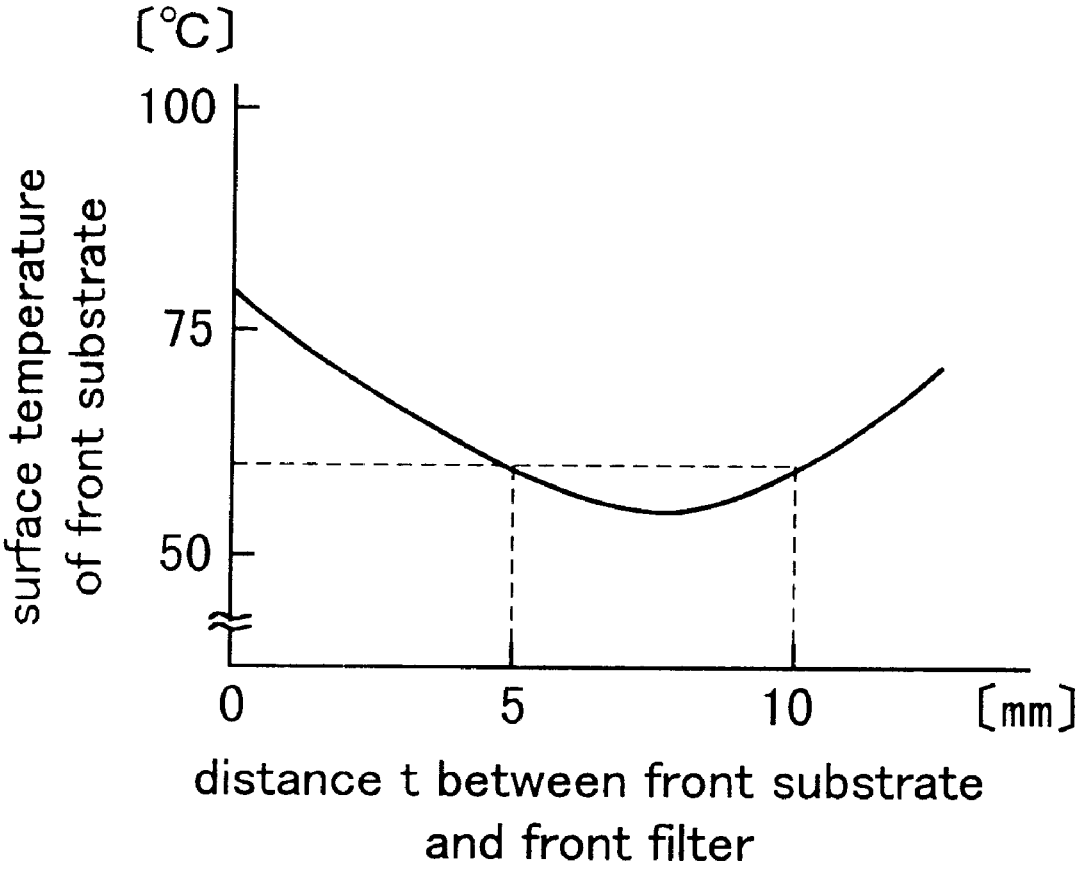
FIG. 6 is a graph showing the result of measuring the surface temperature of the front substrate.
Figure 7:
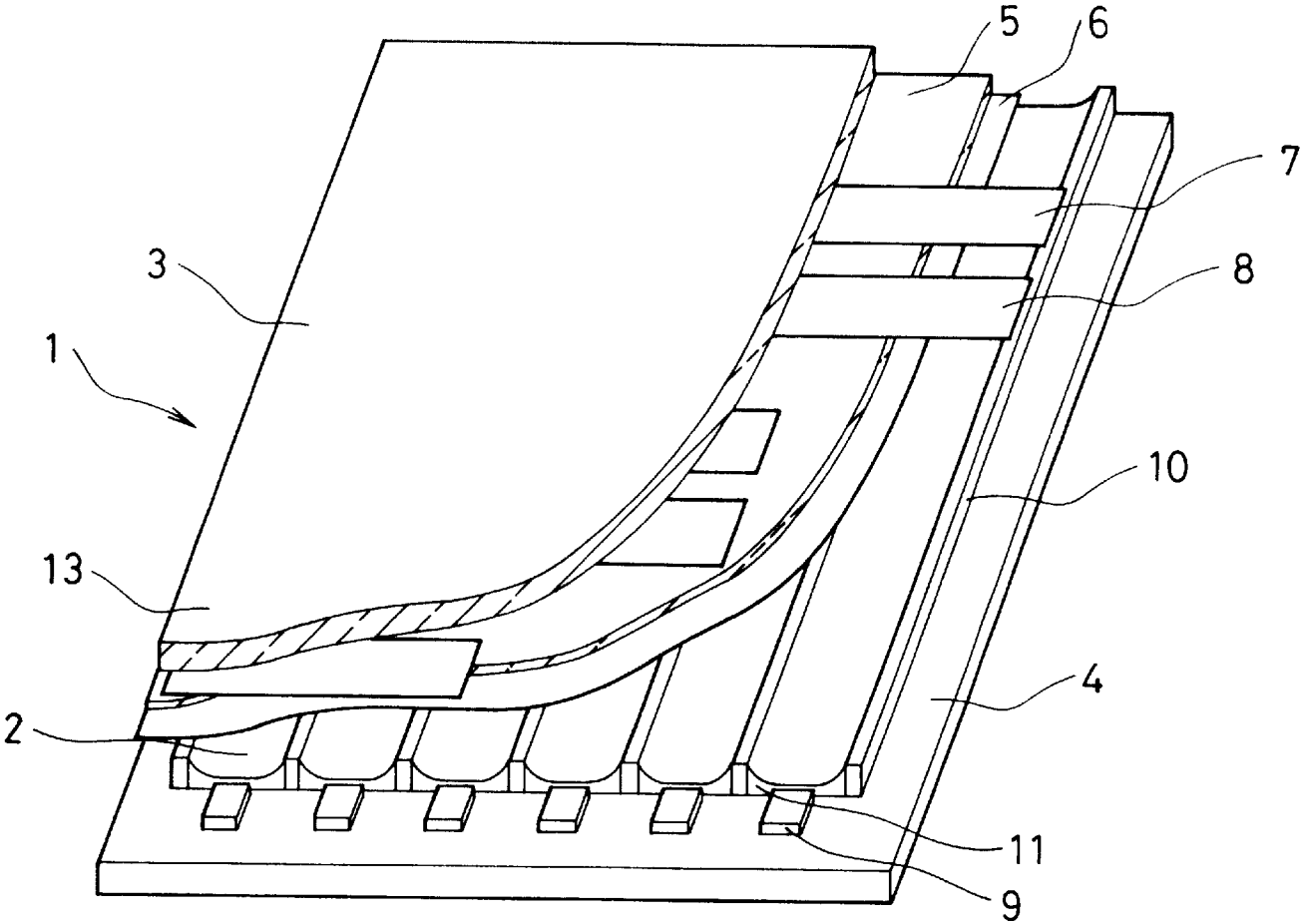
FIG. 7 PRIOR ART
FIG. 7 is a partially broken perspective view illustrating a conventional AC type plasma display panel.

As is shown in FIG. 5, when a gap is provided between the front substrate 13 and the front filter 14, air convection is generated therein, thus enhancing heat dissipation from the front substrate 13. FIG. 6 shows the result of measuring the surface temperature of the front substrate 13 when the distance t between the front substrate 13 and the front filter 14 is changed. In the case of 2 mm≦t≦12.5 mm, the heat dissipation due to convection was enhanced, and the surface temperature of the front substrate was low. In the case of t≦2 mm or t≦12.5 mm, the heat dissipation capacity was low, and the surface temperature of the front substrate 13 was high compared with that of the case of 2 mm≦t≦12.5 mm.

In addition, when the front filter 14 is not provided, the surface temperature of the front substrate is approximately 80° C., which is higher than that in the case of providing the front filter 14 with 2 mm≦t≦12.5 mm (70° C. or lower). Accordingly, disposing the front filter 14 with a gap of 2 mm or more to 12.5 mm or less from the front substrate 13 enhances the heat release of the panel compared with the case of providing no front filter 14. More preferably, adopting 5 mm≦t≦10 mm keeps the surface temperature of the front substrate 13 in a lower range (60° C. or lower).

As is described above, by providing a predetermined gap between the front substrate 13 and the front filter 14 and enhancing the heat dissipation from the panel, temperature rise of the front substrate 13 can be reduced. Therefore, cooling means such as a fan become unnecessary, thereby reducing cost and power consumption.

In the embodiment above, the surface discharge AC type plasma display panel has been described. However, effects similar to the above embodiment can be obtained in other AC type plasma display panels and DC type plasma display panels.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A plasma display panel comprising:

a front substrate, on which a scanning electrode and a sustaining electrode are formed, a back substrate, on which a data electrode is formed, opposing said front substrate and separated therefrom by a discharge space, and a front filter provided at a front side of said front substrate;

wherein mean transmittances of each of said front substrate and said front filter are 60 to 80% respectively when the mean transmittances are a mean value of a transmittance within a wavelength range for visible light (360 to 830 nm).

2. The plasma display panel according to claim 1, wherein belt-like electrodes that are in parallel are provided on said front substrate, and a dielectric layer and a protective coating covering said electrodes are formed in this order.

3. The plasma display panel according to claim 1, wherein a gap is provided between said front substrate and said front filter.

4. The plasma display panel according to claim 3, wherein said gap is 2 to 12.5 mm.

5. The plasma display panel according to claim 1, wherein said front filter is made of a resin or a glass.

* * * * *